US005509147A

United States Patent [19]

Busquets

[11] Patent Number: 5,509,147

[45] Date of Patent: Apr. 23, 1996

[54] MULTI-POCKET SYSTEM FOR A GARMENT

[76] Inventor: Agustin A. Busquets, 23300 Providence Dr., Apartment 210, Southfield, Mich. 48075

[21] Appl. No.: 206,958

[22] Filed: Mar. 7, 1994

[51] Int. Cl.[6] ..... A41D 27/20

[52] U.S. Cl. ..... 2/253; 2/247; 112/441

[58] Field of Search ..... 2/253, 247, 250, 2/251, 252, 254, 94, 115, 108, 102, 85, 95, 93, 69; 112/441

[56] References Cited

U.S. PATENT DOCUMENTS

| | | | |
|---|---|---|---|
| 1,982,100 | 11/1934 | Heile . | |
| 2,038,331 | 4/1936 | Woolf . | |
| 2,312,177 | 2/1943 | Lester . | |
| 2,407,888 | 9/1946 | Lesser . | |
| 2,489,868 | 11/1949 | Dowling et al. . | |
| 2,642,576 | 6/1953 | Kotkes . | |
| 2,678,744 | 5/1954 | Bracken | 2/94 |
| 2,882,532 | 4/1959 | O'Donnell . | |
| 2,967,307 | 1/1961 | O'Donnell . | |
| 3,047,877 | 8/1962 | Palazzo | 2/253 |
| 4,266,297 | 5/1981 | Atkins | 2/94 |
| 4,475,251 | 10/1984 | Hopkins | 2/94 |
| 4,637,075 | 1/1987 | Ingrisano et al. . | |
| 4,896,377 | 1/1990 | Ferdi . | |
| 5,014,359 | 5/1991 | Hanson . | |
| 5,031,244 | 7/1991 | Inagaki | 2/102 |
| 5,072,456 | 12/1991 | Elin | 2/102 |
| 5,325,538 | 7/1994 | Schoenweiss et al. | 2/102 |
| 5,331,683 | 7/1994 | Stone et al. | 2/102 |

*Primary Examiner*—C. D. Crowder
*Assistant Examiner*—Gloria Hale
*Attorney, Agent, or Firm*—Gifford, Krass, Groh, Sprinkle, Patmore, Anderson & Citkowski

[57] ABSTRACT

A garment has a multi-pocket system for storing articles generally carried by a traveler. The garment includes a front panel having an outside and inside surface. A pocket assembly which has a plurality of pockets is secured on the outside surface of the front panel of the garment. The plurality of pockets are accessible from the outside of the garment. At least one pocket is positioned on the inside surface of the front panel of the garment. The at least one pocket is accessible from the inside of the garment. The plurality of outside pockets are associated with the at least one inside pocket.

10 Claims, 3 Drawing Sheets

MULTI-POCKET SYSTEM FOR A GARMENT

BACKGROUND OF THE INVENTION

The present invention relates to wearing apparel and, more particularly, to garments with multi-pocketed systems.

Several types of garments exist in the field which have a plurality of pockets. Several of these garments are utilized for different purposes and some of the garments have specialty uses. The following U.S. Pat. Nos. 1,982,100, 2,038,331, 2,312,177, 2,407,888, 2,489,868, 2,642,576, 2,882,532, 2,967,307, 4,637,075, 5,014,359 and 4,896,377 illustrate various types of garments having a plurality of pockets. While these various types of pocketed garments appear to work satisfactorily for their intended purpose, they fail to provide desired pocketing for travelers.

Travelers, particularly airline passengers, carry several different types of articles. Generally, most travelers prefer to have their articles in their pockets, on their person, rather than in handbags, purses or briefcases. Articles generally carried by travelers include airline tickets, boarding passes, passports, wallets or billfolds, credit cards, travelers checks, eyeglass cases, writing utensils, combs, loose change and other small articles. Generally, it is desirable to have these items close at hand.

SUMMARY OF THE INVENTION

The present invention provides the art with a multi-pocket system which is attached to a front panel or panels of a single garment to alleviate the carrying of several articles in separate places, such as trousers, coats, jackets, pullovers, handbags, purses, briefcases, or the like.

Another object of the invention is to maximize the useable space on the front portion of a garment by overlapping the pockets.

Another object of the invention is provide a garment with interior pockets as well as exterior pockets, enabling valuables to be concealed and secured inside the garment.

The present invention provides different pockets to carry a number of different articles to separate, sort and keep articles separate so that the traveler is well organized and is well aware of his valuable articles at all times.

From the following detailed descriptions taken in conjunction with the accompanying drawings and claims, other objects and advantages of the present invention will become apparent to those skilled in the art.

DETAILED DESCRIPTION OF THE PREFERRED EMBODIMENT

Figure 1:
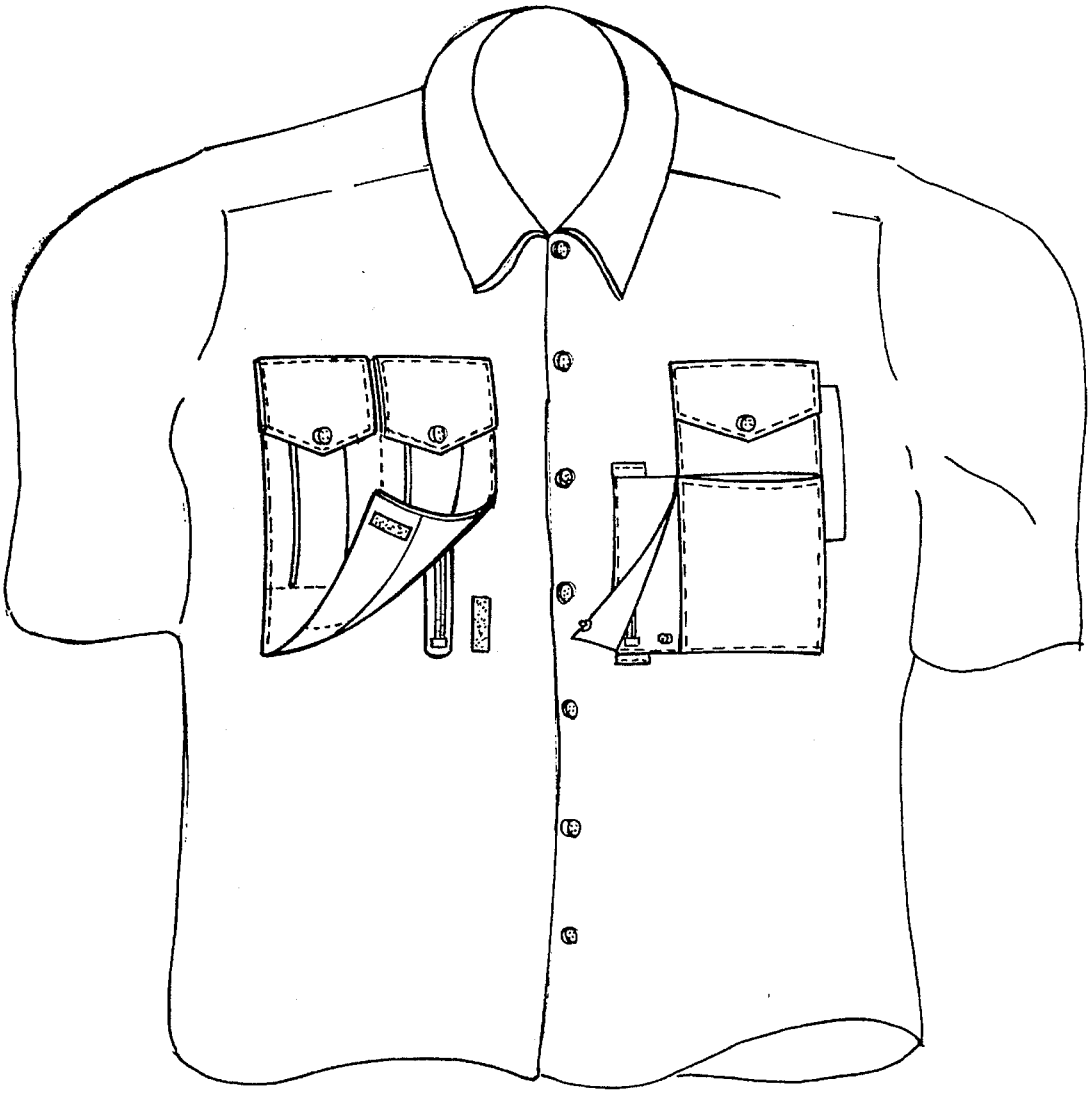
FIG. 1 is a perspective view of a garment including a multi-pocketed system in accordance with the present invention.

Turning to the figures, particularly FIG. 1, a garment 10 is illustrated as a shirt. The garment may be a coat, vest, jacket or the like. The garment 10 includes a multi-pocket system designated with the reference numeral 20. The garment includes a front panel 22 with an outside surface 24 and an inside surface 26. The multi-pocket system 20 includes two pocket sub-assemblies 28 and 30.

The pocket sub-assembly 28 has an overall rectangular shape with its longitudinal length being somewhat larger than its lateral length, however, depending upon the particular articles to be carried, the pockets may be modified to meet the desired task.

The pocket sub-assembly 28 includes a plurality of pockets designated with the reference numerals 32, 34, 36 and 38. Generally the pockets 32 and 34 are to carry eyeglass cases, the pocket 36, a comb and the pocket 38, loose change. The pockets 32 and 34 are generally formed from a front panel 40 and rear panel 42 which are sewn together and include a longitudinal hem 44 which separates the pockets from one another. The longitudinal hem 44 may extend partially or it may extend the entire length of the pockets 32 and 34. Flaps 46 and 48 cover the openings of the pockets 32 and 34 and are secured to the pockets by buttons 50 and 52. Both pockets 32 and 34 include box pleats 54 and 56 which enable the pockets to expand when carrying eyeglass cases. Also, a second set of buttons 58 and 60 enable the flaps 46 and 48 to be secured with the pockets 32 and 34 when the pockets are full. Thus, the buttons provide the garment with a neat look when the pockets are empty and when the pockets are full.

Figure 2:
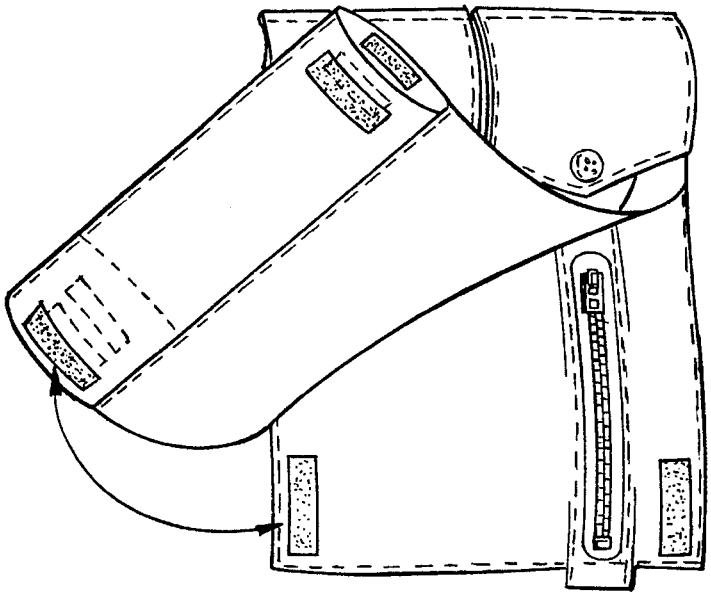
FIG. 2 is a perspective view of one of the pocket assemblies with the pocket folded upon itself.

The pockets 36 and 38 are generally laterally running with respect to the pockets 32 and 34 (see FIG. 2). The front panel of pockets 36 and 38 is the rear panel 42 which continues from pockets 32 and 34. A back panel 60 is sewn onto the panel 42 to provide pockets 36 and 38. A dividing hem 62 divides the pockets 36 and 38. The common bottom portion of pockets 36 and 38 may also be shaped like a projected out shallow "V" to reduce the possibility of their contents coming out. Also, the pockets 36 and 38 may be sewn on their lateral edges and open on their longitudinal edges of the pockets 36 and 38 and be closed with a hook and loop or the like fastener. As can be seen in FIGS. 1 and 2, if the common bottom portion of pockets 36 and 38 is a straight line, the bottom of pocket sub-assembly 28 may be rolled on itself, since the pocket sub-assembly is not fully sewn along its longitudinal length onto the garment 10. As seen in FIG. 2, hook and loop fasteners 64, 66, 68 and 70 secure the pocket sub-assembly 28 to the garment front panel 22.

Figure 3:
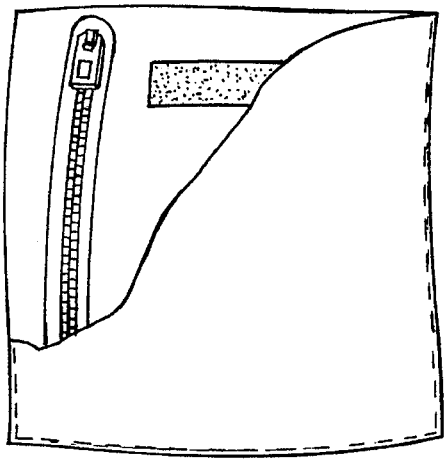
FIG. 3 is a perspective view partially cut away of an interior pocket in accordance with the present invention.
Figure 4:
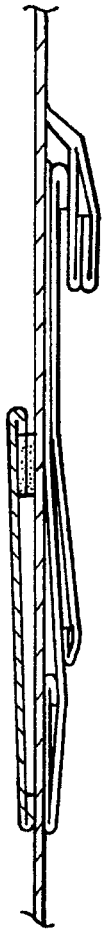
FIG. 4 is a cross sectional view of FIG. 1 along lines 4—4 thereof.
Figure 5:
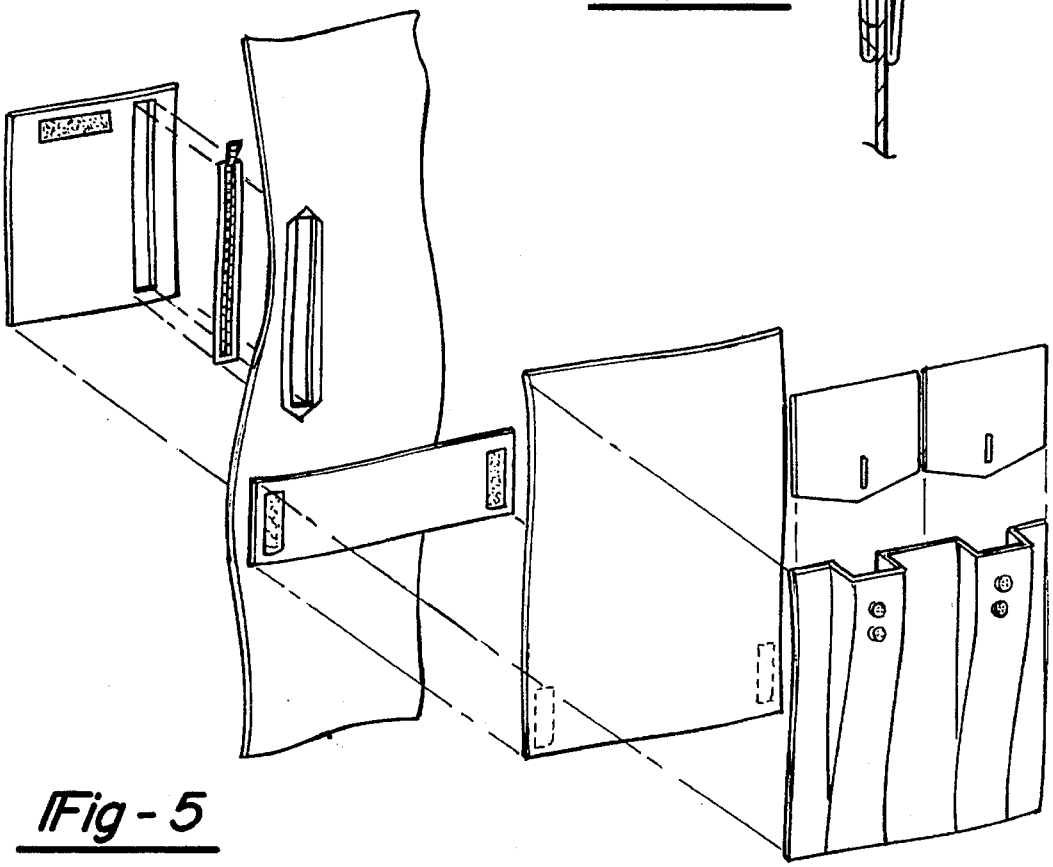
FIG. 5 is an exploded view of the pocket of FIG. 1.

As can be seen in FIG. 2, upon moving the pocket subassembly 28 away from the garment front panel 22, zipper 72 is exposed which enables entrance into-interior pocket 74 (see FIGS. 1 and 3). The zipper 72 may be replaced with a hook and loop or other types of snaps or buttons to provide a closure for the garment. The interior pocket 74 is sewn and secured onto the interior surface 26 of the front panel 22° The interior pocket panel 75 is open at its upper lateral edge enabling access from inside the garment. Also, a hook and loop fastener 76 is positioned onto the top edge of the panel to keep the pocket 74 in a closed position. Generally, the interior pocket 74 is utilized for storage of a wallet, credit cards, travelers checks or other valuables.

Figure 6:
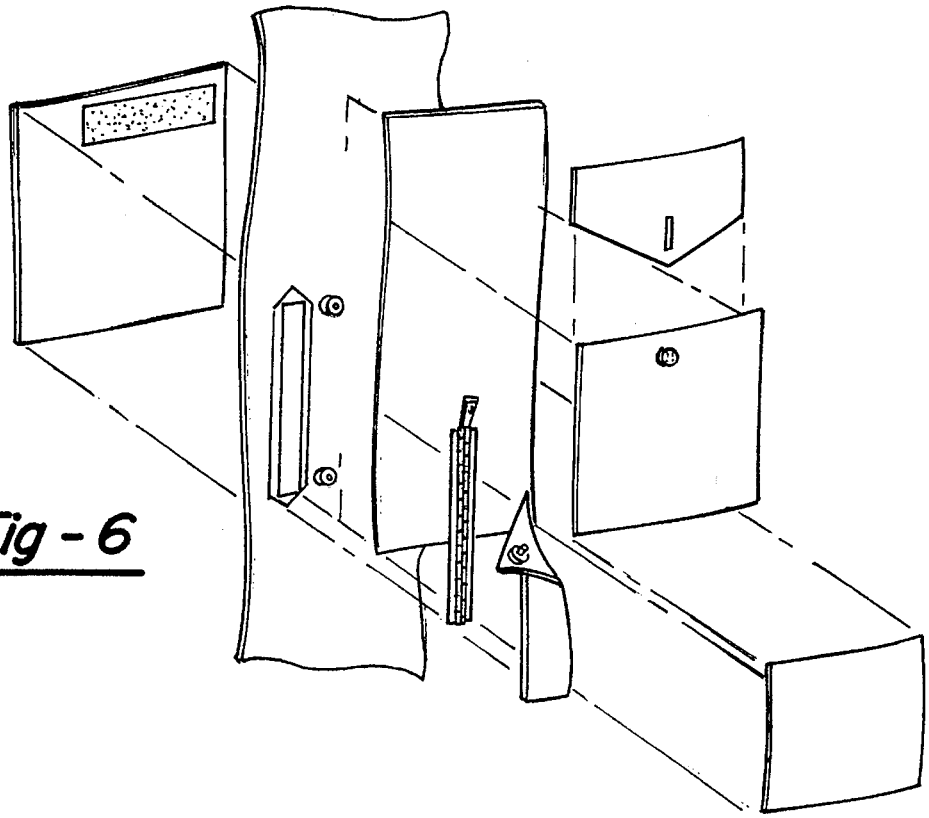
FIG. 6 is an exploded view of one of the pocket assemblies in accordance with the present invention.
Figure 7:
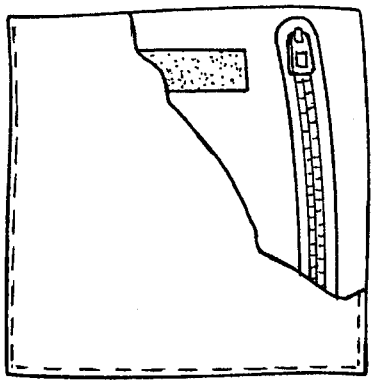
FIG. 7 is a perspective view partially cut away of a rear pocket of FIG. 6 in accordance with the present invention.
Figure 8:
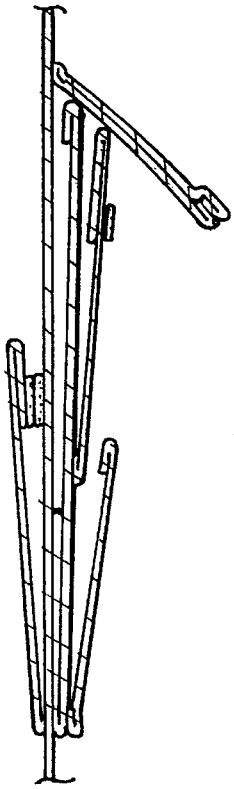
FIG. 8 is a cross sectional view of FIG. 1 along line 8—8 thereof.

Turning to the second pocket sub-assembly 30, the pocket sub-assembly has an overall rectangular shape with the longitudinal length being longer than the lateral width. The pocket sub-assembly 30 includes a plurality of pockets designated with the reference numerals 90, 92, 94 and 96 as seen in FIGS. 1 and 8. Pockets 94 and 92 are overlaid onto pocket 90. The top edges of pockets 92 and 96 are below the top edge of pocket 90, as seen in FIG. 8, to facilitate locating the desired pocket to insert an airline ticket or passport. Pocket 90 is formed from a front panel 98 and the garment front panel 22 which acts as the rear panel of the pocket 90 as seen in FIG. 6. The panel 98 acts as the rear panel for pocket 92 which includes front panel 100. The panel 100 also forms the pocket 96 which may be used to carry a pen, pencil or the like. The panel 100 of pocket 92 extends into the pocket 94. However, the majority of the back panel of the pocket 94 is formed from the front panel 98 of the pocket 90. An additional front panel 102 is positioned over the panel 98 to form the pocket 94. Generally, the pocket 90 is utilized for an airline ticket or the like, which can be placed into the pocket and extend the entire length of the pocket. Pocket 92 and 94 may be utilized for a passport or boarding pass.

A flap 104 is sewn on to the garment panel 22 and covers the top edge of pockets 90 and 92. The flap 104 is secured to the pocket by button 106.

Flap 108 covers a zipper 110 which provides access to an interior pocket 112. The flap 110 includes snaps 114 which secures the flap 108 to the garment front panel 22. The snaps 114 could be hook and loop fasteners or the like to removably retain the flap onto the garment front panel 22. The pocket 112 on the interior of the shirt includes a panel with a box pleat 116 as well as hook and loop fasteners 118 at its top lateral edge to enable access into the pocket from inside the garment. The pocket panel 113 has an overall rectangular shape with the lateral width being greater than the longitudinal length of the pocket.

The garment described above is manufactured according to the following method.

Figure 9:
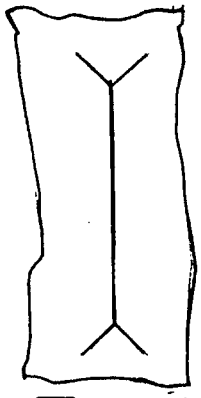
FIG. 9 is a plan view of an opening for securing the closure of the interior pocket.
Figure 10:
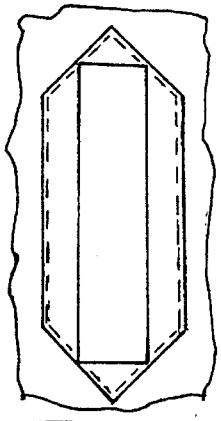
FIG. 10 is a plan view of FIG. 9 with the tabs folded inward.
Figure 1:
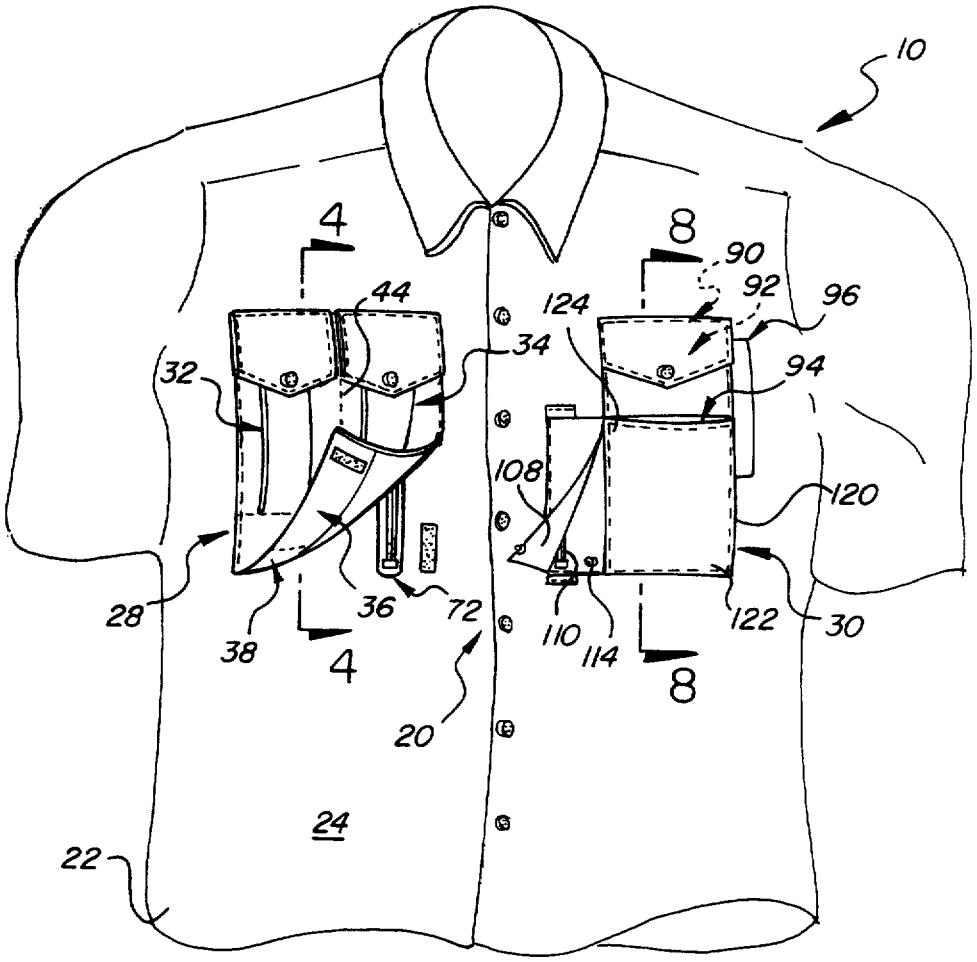
Figure 2:
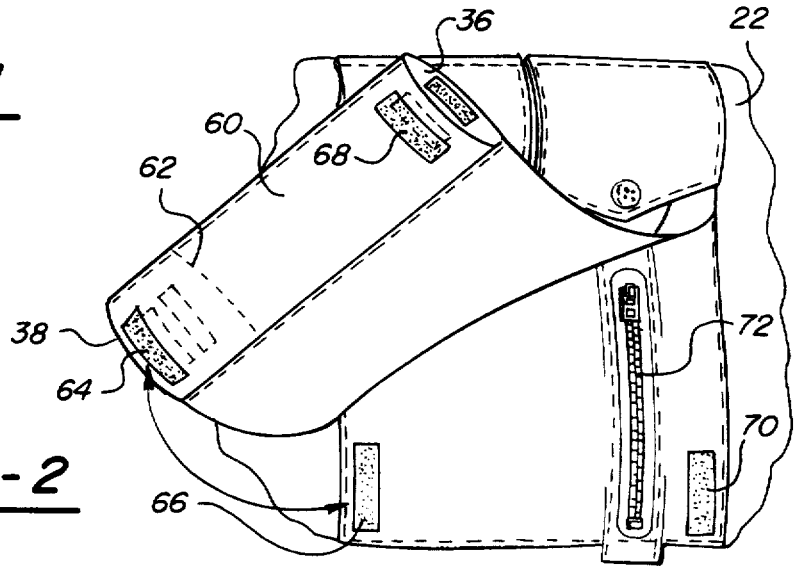
Figure 3:
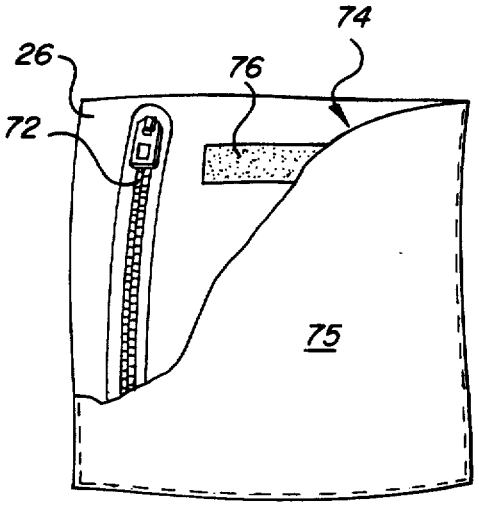
Figure 4:
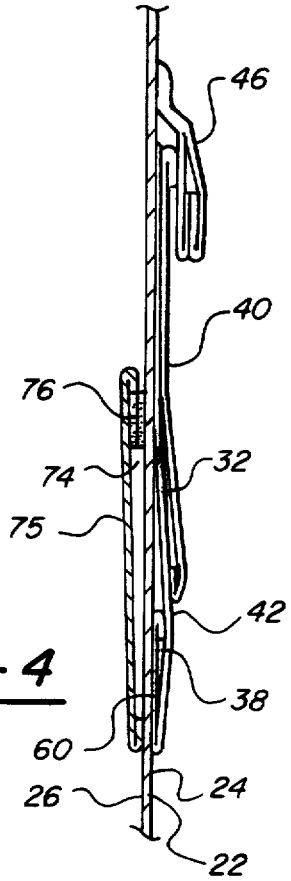
Figure 5:
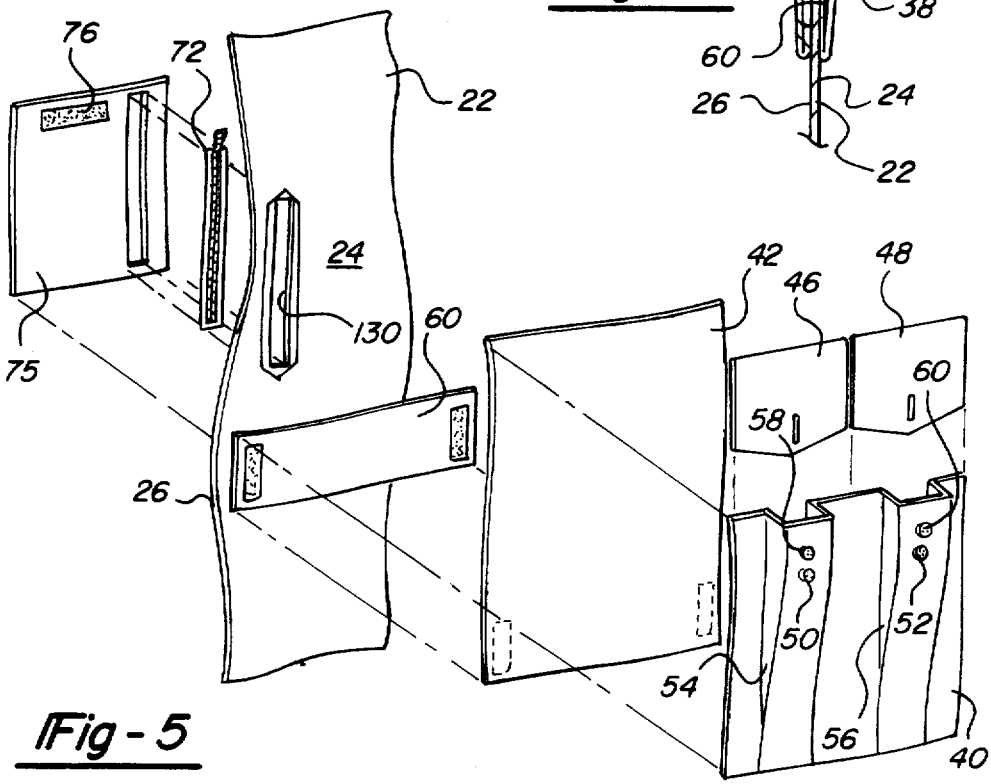
Figure 6:
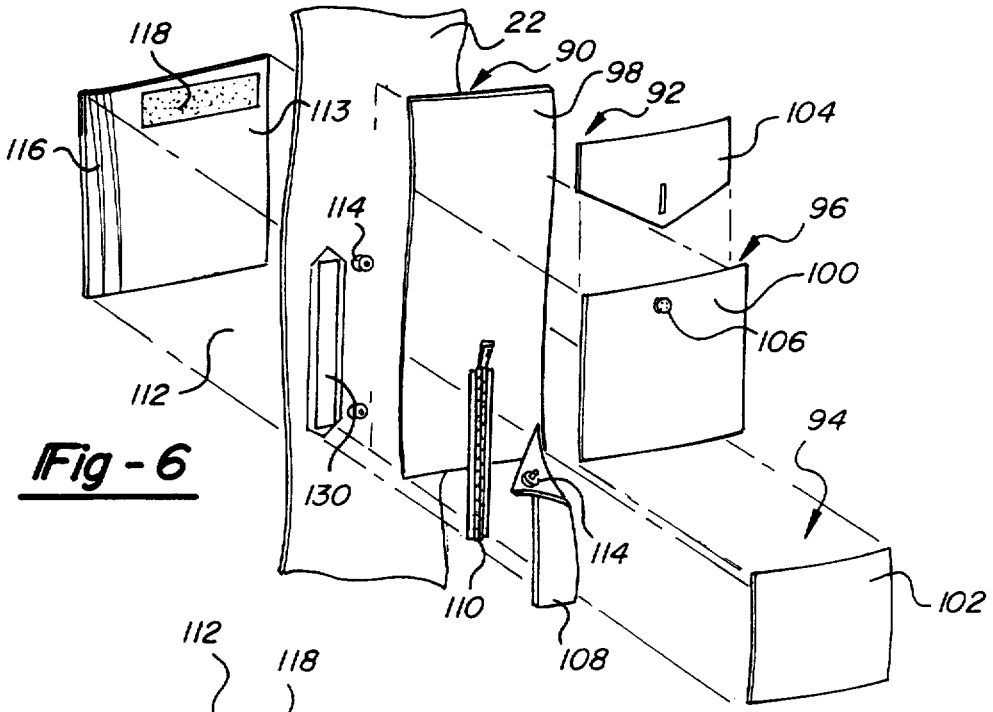
Figure 7:
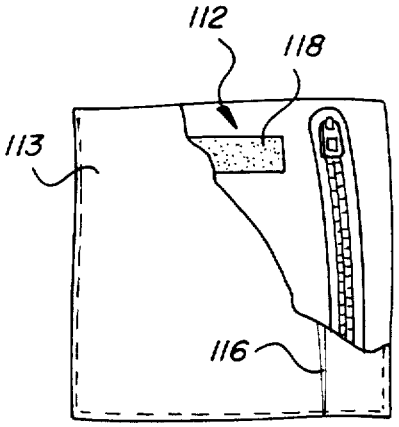
Figure 8:
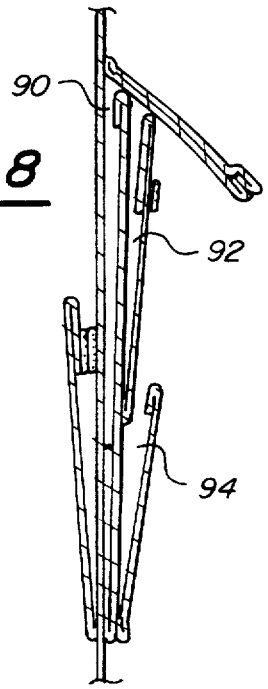
Figure 9:
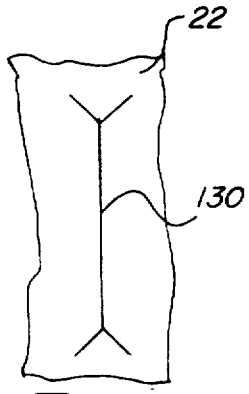
Figure 10:
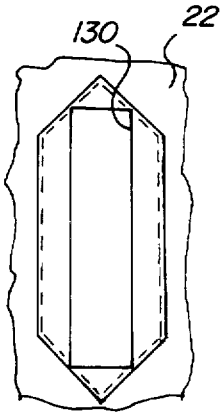

The pocket sub-assembly 28 is formed by first panel 40, with the pleats 54 and 56 formed therein as well as with the buttons attached, overlaid onto the panel 42. The panels 40 and 42 are overlaid onto the garment front panel 22. The panels 40 and 42 are sewn together and a portion of the panels 40, 42 are sewn onto the front panel 22 of the garment. The upper lateral edge as well as approximately half of the longitudinal edges of the pocket assembly 28 are sewn onto the front panel of the garment. The longitudinal hem 44 is sewn through the pockets onto the garment front panel 22. Prior to sewing the pocket assembly onto the front panel, panel 60 is sewn onto the back of the panel 42 forming pockets 36 and 38. The hook and loop fasteners are secured to the back panel 60 of the pockets 36 and 38 as well as to the garment front panel 22. The interior pocket 74 is formed by a slit 130 being cut into the garment panel 22 (FIG. 9). The slit 130 is hemmed back (FIG. 10) so that the zipper can be sewn onto the garment panel 22. After sewing the zipper onto the garment panel 22, the panel of pocket 74 is sewn onto the interior surface 26 of the garment front panel 22. Also, prior to sewing the panel onto the inside of the garment front panel 22, hook and loop fasteners 76 are positioned on the inside surface 26 of the garment front panel 22 and on the pocket panel. After the pockets are sewn onto the front panel of the garment, the flaps 46 and 48 are added to the front panel 22 which secure with the buttons.

Pocket sub-assembly 30 is added to the garment 10 in the following manner. The front panel of pocket 90, front panel of pocket 92 and front panel of pocket 94 are cut and overlaid one on top of the other. Also, the panel 113 of the interior pocket 112 is cut to include its box pleat 116 and its hook and loop fastener is added to the interior of the pocket panel. All pocket panels are laid out on the front panel 22 of the garment 10. The right edge 120 is sewn onto the panel of the shirt. The right edge 120 is common to all of the pockets in pocket sub-assembly 30. Also, the remainder of the panel 100 may be sewn around its edges to provide pocket 96. The slit 130 is cut into the panel of the garment 10 and the zipper 110 is installed into the panel. The interior pocket is aligned so that a common bottom edge 122 can be sewn coupling pockets 90, 94 and interior pocket 112. Prior to the sewing of the common edge 122, the other longitudinal edge 124 is sewn to form the sides of pockets 90, 92 and 94. After the sewing of the common edge of the interior pocket to the exterior pockets, the remaining edge of the interior pocket is sewn onto the inside of the garment panel. Also, the hook and loop fastener at the top edge of the interior pocket 112 is added to the front panel of the garment prior to sewing of the pockets onto the shirt panel. The pocket 94 bottom lateral edge is sewn to the panel of the pocket 90 prior to securing the edge 122.

Prior to or after the sewing of the pockets, the snaps and buttons may be added to the pockets and the front panel. Flaps 104 and 108 are added to the shirt after or before the pockets are sewn onto the garment.

Upon sewing the pocket sub-assemblies 28 and 30 onto the front panel of the garment, a garment in accordance with the invention is manufactured.

While the above detailed description describes the preferred embodiment of the present invention, the invention is susceptible to modification, variation, and alteration without deviating from the scope and fair meaning of the subjoined claims.

I claim:

1. A method of manufacturing a garment comprising:

providing a garment having a front panel including inside and outside surfaces;

providing a pair of panels;

sewing said pair of panels to said outside surface of said front panel on a first side thereof forming a plurality of longitudinal pockets on said garment;

sewing a panel to one panel of said pair of panels to form at least one lateral pocket;

cutting a slit in said front panel;

securing a closure fastener in said slit;

sewing a panel on the inside surface of said garment front panel to form an interior pocket;

providing at least three panels overlaid on one another and on said outside surface of said one panel on a second side of said garment front panel;

sewing a common hem on an edge of said three panels;

cutting a slit in said front panel;

securing a closure fastener in said slit; and sewing a panel on the inside of said garment front panel to form an interior pocket.

2. The method according to claim 1 further comprising securing flaps on said garment front panel to cover an open edge of said plurality of pockets.

3. The method according to claim 1 further comprising sewing a portion of said plurality of longitudinal pockets to said garment front panel for enabling said plurality of longitudinal pockets to be moved to enable access to said closure fastener.

4. The method according to claim 1 further comprising a fourth panel with said at least three panels and sewing said fourth panel to form an additional pocket.

5. A dual access security pocket assembly for use with an upper garment having an inner and an outer surface, said pocket assembly including;

an exterior pocket with an access opening disposed on the outer surface of the garment and including a first portion permanently attached to said garment;

means for detachably securing a second portion of said exterior pocket to said garment such that said exterior pocket may be swung away from said garment;

a slit formed in said garment on a location thereon underlying said exterior pocket such that said slit is normally concealed by said exterior pocket when said exterior pocket second portion is detachably secured to said garment; and an interior pocket attached to said garment inner surface and including an interior access opening thereto, said interior pocket communicating with said slit such that said interior pocket is accessible from both said inner and outer surfaces of said garment.

6. The pocket assembly of claim 5 further comprising means for closing said slit.

7. The pocket assembly of claim 5 wherein said securing means comprises mating portions of hook and loop fastener disposed on, respectively, said exterior pocket second portion and said garment outer surface.

8. The pocket assembly of claim 6 wherein said closure means comprises a zipper.

9. The pocket assembly of claim 5 wherein said exterior pocket further includes a secondary pocket extending from a bottom edge thereof, and said securing means further includes matable first and second members disposed on, respectively, said secondary pocket and said garment outer surface.

10. The pocket assembly of claim 9 wherein said exterior pocket access opening is disposed along a top edge of said pocket and said secondary pocket further includes a vertical access opening.

* * * * *

UNITED STATES PATENT AND TRADEMARK OFFICE

CERTIFICATE OF CORRECTION

PATENT NO. : 5,509,147

DATED : April 23, 1996

INVENTOR(S) : Agustin A. Busquets

It is certified that error appears in the above-indentified patent and that said Letters Patent is hereby corrected as shown below:

Column 1, line 38 after "is" insert --to--.

Column 2, line 62 delete "into-interior" and insert --into interior--.

Column 2, line 67 delete 22° and insert --22--

The title page should be deleted to appear as attached title page.

Figures 1-10 should be deleted and replaced with Figures 1-10 as shown on the attached sheets.

Signed and Sealed this

Fifteenth Day of October, 1996

*Attest:*

Bruce Lehman

BRUCE LEHMAN

*Attesting Officer*

*Commissioner of Patents and Trademarks*

United States Patent [19]

Busquets

[11] Patent Number: 5,509,147

[45] Date of Patent: Apr. 23, 1996

[54] MULTI-POCKET SYSTEM FOR A GARMENT

[76] Inventor: Agustin A. Busquets, 23300 Providence Dr., Apartment 210, Southfield, Mich. 48075

[21] Appl. No.: 206,958

[22] Filed: Mar. 7, 1994

[51] Int. Cl.[6] ..... A41D 27/20

[52] U.S. Cl. ..... 2/253; 2/247; 112/441

[58] Field of Search ..... 2/253, 247, 250, 2/251, 252, 254, 94, 115, 108, 102, 85, 95, 93, 69; 112/441

[56] References Cited

U.S. PATENT DOCUMENTS

| | | | |
|---|---|---|---|
| 1,982,100 | 11/1934 | Heile . | |
| 2,038,331 | 4/1936 | Woolf . | |
| 2,312,177 | 2/1943 | Lester . | |
| 2,407,888 | 9/1946 | Lesser . | |
| 2,489,868 | 11/1949 | Dowling et al. . | |
| 2,642,576 | 6/1953 | Kotkes . | |
| 2,678,744 | 5/1954 | Bracken | 2/94 |
| 2,882,532 | 4/1959 | O'Donnell . | |
| 2,967,307 | 1/1961 | O'Donnell . | |
| 3,047,877 | 8/1962 | Palazzo | 2/253 |
| 4,266,297 | 5/1981 | Atkins | 2/94 |
| 4,475,251 | 10/1984 | Hopkins | 2/94 |
| 4,637,075 | 1/1987 | Ingrisano et al. . | |
| 4,896,377 | 1/1990 | Ferdi . | |
| 5,014,359 | 5/1991 | Hanson . | |
| 5,031,244 | 7/1991 | Inagaki | 2/102 |
| 5,072,456 | 12/1991 | Elin | 2/102 |
| 5,325,538 | 7/1994 | Schoenweiss et al. | 2/102 |
| 5,331,683 | 7/1994 | Stone et al. | 2/102 |

*Primary Examiner*—C. D. Crowder
*Assistant Examiner*—Gloria Hale
*Attorney, Agent, or Firm*—Gifford, Krass, Groh, Sprinkle, Patmore, Anderson & Citkowski

[57] ABSTRACT

A garment has a multi-pocket system for storing articles generally carried by a traveler. The garment includes a front panel having an outside and inside surface. A pocket assembly which has a plurality of pockets is secured on the outside surface of the front panel of the garment. The plurality of pockets are accessible from the outside of the garment. At least one pocket is positioned on the inside surface of the front panel of the garment. The at least one pocket is accessible from the inside of the garment. The plurality of outside pockets are associated with the at least one inside pocket.

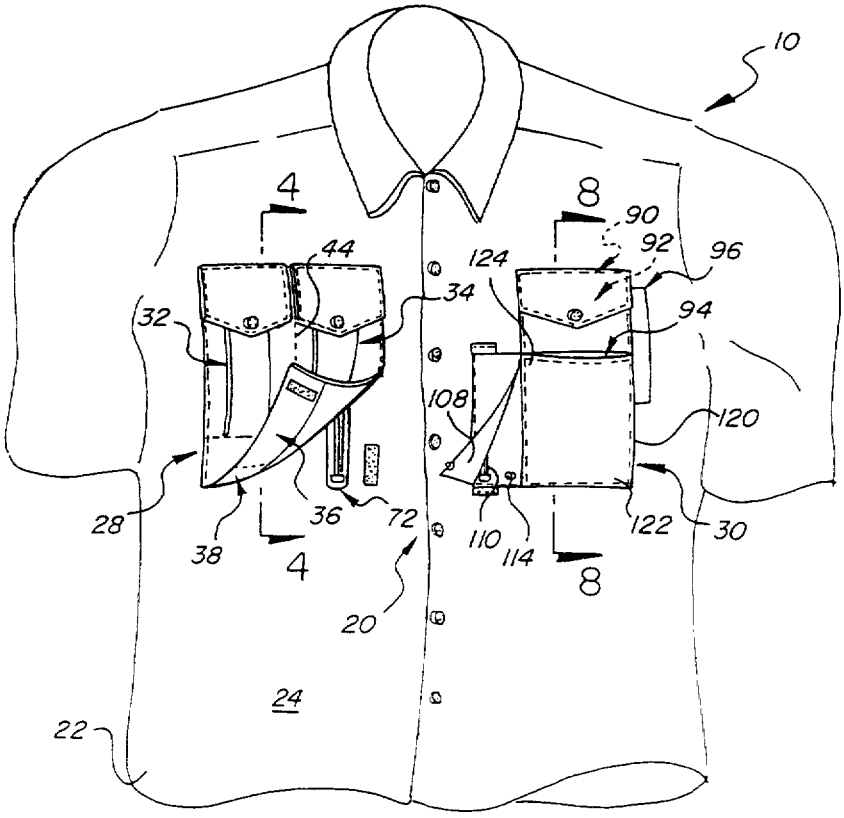

10 Claims, 3 Drawing Sheets